US006814111B1

(12) United States Patent
Oliverio et al.

(10) Patent No.: US 6,814,111 B1
(45) Date of Patent: Nov. 9, 2004

(54) ADJUSTABLE VOLUME SIDE DISCHARGE FEEDER

(75) Inventors: Frank G. Oliverio, Cincinnati, OH (US); Boris E. Makutonin, Cincinnati, OH (US); Robert B. McCaslin, Fort Thomas, KY (US)

(73) Assignee: R.A. Jones & Co. Inc., Crescent Springs, KY (US)

( * ) Notice: Subject to any disclaimer, the term of this patent is extended or adjusted under 35 U.S.C. 154(b) by 0 days.

(21) Appl. No.: 10/409,865

(22) Filed: Apr. 9, 2003

Related U.S. Application Data

(60) Provisional application No. 60/371,484, filed on Apr. 10, 2002.

(51) Int. Cl.[7] ..... B65B 43/42

(52) U.S. Cl. ..... 141/237; 141/1; 141/152; 141/176; 141/222; 141/367

(58) Field of Search ..... 141/1, 10, 114, 141/144, 145, 152, 176, 237, 376; 222/305–308, 367, 368, 370

(56) References Cited

U.S. PATENT DOCUMENTS

| | | | | |
|---|---|---|---|---|
| 3,821,873 A | | 7/1974 | Benner, Jr. et al. | |
| 5,320,146 A | * | 6/1994 | Stevie | 141/1 |
| 5,405,059 A | * | 4/1995 | Wadell | 222/306 |
| 6,119,440 A | | 9/2000 | Benner, Jr. et al. | |

* cited by examiner

*Primary Examiner*—Gregory L. Huson
*Assistant Examiner*—Peter deVore
(74) *Attorney, Agent, or Firm*—Wood, Herron & Evans LLP

(57) ABSTRACT

An adjustable, side discharge side discharge volumetric feeder particularly suitable for handling products of large articulate configurations. Product is rate fed to a plurality of volumetric chambers having a movable bottom for volume adjustment and an open side wall covered and uncovered by a belt for product discharge. Process and alternatives are disclosed. The feeder manages large particulates such as snacks, pet foods, cereals, candy and the like in a volumetric manner, at high speeds up to 1500 pouches per minute in a gentle manner that minimizes product breakage.

37 Claims, 6 Drawing Sheets

ADJUSTABLE VOLUME SIDE DISCHARGE FEEDER

PRIORITY CLAIM

Applicant claims the priority of the filing date of United States provisional patent application entitled "STAND UP POUCH FORMING, FILLING AND SEALING" filed on Apr. 10, 2002, Ser. No. 60/371,484.

FIELD OF THE INVENTION

This invention relates to feeders for feeding product on discrete volumetric-measured changes and more particularly to volumetric feeders of large particulate products. The feeder is useful for filling product into open pouches preferably comprising a train of pouches temporarily connected serially at common edge or vertical seam seals, and is particularly used for feeding larger particulate product into larger pouches, including pouches of the stand-up pouch configuration.

BACKGROUND OF THE INVENTION

In the past, it has been known to feed product into pouches through the use of a feeder and a filler wheel about which a train of open-top pouches is directed. Product is fed to a filler wheel and passes through spouts inserted in the open-top mouths of the pouches. Examples of such apparatus are found, for example, in U.S. Pat. Nos. 3,821,873; 5,320,146 and 6,119,440. U.S. Pat. No. 5,320,146 describes a volumetric feeder where a belt is disposed about a feeder wheel to close off the bottoms of fixed, open bottom volumetric cavities, but is pulled away to dump the fill in the cavity through its bottom discharge port and into a spout for pouch filling. A cup feeder or dispenser 14 is used to dispense product onto a top surface of a feeder wheel, the circular discharge end of the dispenser facing the wheel depositing product on the plate as it moves thereunder.

While these known devices have certain particular utilities, they do not provide systems capable of adequately handling large particulate products in volumetric measure. Such larger particulates as cereal, candies, pet foods, chips, snacks and the like are typically larger than the product dispensed in prior devices (such as powders). The larger particulates are fragile, frequently assymetrically shaped, and generally difficult to handle with accurate measure and without degrading the product by abrasion and the like. For example, if large particulates were deposited by the dispensing spout of U.S. Pat. No. 5,320,146, they could be captured by the lower edge of the spout on the ring feeder and by each other, or by the rotating plate beneath the cup feeder, for example, grinding or damaging partially released product. In addition, large particulates can bridge in such a dispenser, or in the cylindrical volumetric receiving chambers and frequently cause uneven or inaccurate fills. And it will be appreciated that in volumetric feeding and pouch filling, consistent density of the product charge is highly desired for consistent volume and product packaging.

Moreover, there is no provision in the known prior systems (other than a parts change-out) for adjusting the volumetric product charge for change size changes or based on long term trends demanding adjustment in product density changes during operation. And there is nothing suggested to avoid the anticipated bridging problems of large particulates in the system.

Accordingly, it is one objective of this invention to provide improved apparatus and methods for feeding product in large particulate form, as opposed to smaller particulates such as powder, and in accurate volumetric charges for downstream handling such as for filling into pouches.

Another objective of the invention has been to provide improved apparatus and methods for adjusting volumetric chambers in a volumetric feeder to desired volumetric product charges.

A further objective of the invention has been to provide apparatus for handling large particulate products in a feeder without producing bridging.

To these and other ends, the invention in a preferred embodiment includes a volumetric feeder comprising a wheel defining a plurality of volumetric product receiving and discharging chambers fed by a product rate feeder. Product is rate-fed onto a plate and into a plurality of adjustable volumetric chambers. An entire side of the chamber comprising a major chamber wall is defined by a belt engaging a periphery of the wheel. The belt is directed away from the wheel to open the chamber side and to allow product to discharge from the chamber into a large spout mouth for depositing into an open pouch, for example.

Product is fed onto the wheel via rate-driven belt and vibratory tray, with no cup or tube feed and no product grinding. A sensor senses the height of the large particulate product on the wheel and speeds or slows the product rate feeder as the height or depth of product on the wheel decreases or increases respectively.

Since a major chamber wall is defined by the discharge belt which simply moves away from the chamber or discharge, the discharge opening is larger in cross-section than the cross-section of product flow in the chamber and product is easily discharged with no bridging. Moreover, the gentle belt departure from the chamber allows a very gentle discharge motion for fragile particulates.

The volumetric chambers of the wheel are preferably defined by extruded members with an open chamber side and a movable puck which can be raised or lowered to decrease or increase the chamber volume, respectively. These pucks can be adjusted to set position for a specific volumetric charge desired. The invention contemplates also their on-the-fly adjustment to adapt the feeder to long term trends in the product density or in the volumetric product charges being produced.

Thus, the invention provides improved apparatus and methods for feeding consistent volumetric charges of large particulate product without undue product degradation or bridging. Large particulate products can be packaged in pouches running in typical fashion but without the drawbacks of prior pouch systems with respect to handling large particulates.

These and other objectives and advantages will become readily apparent from the following detailed description of a preferred embodiment of the invention and from the drawings in which:

DESCRIPTION OF THE DRAWINGS AND OF THE INVENTION

DETAILED DESCRIPTION

Figure 1:
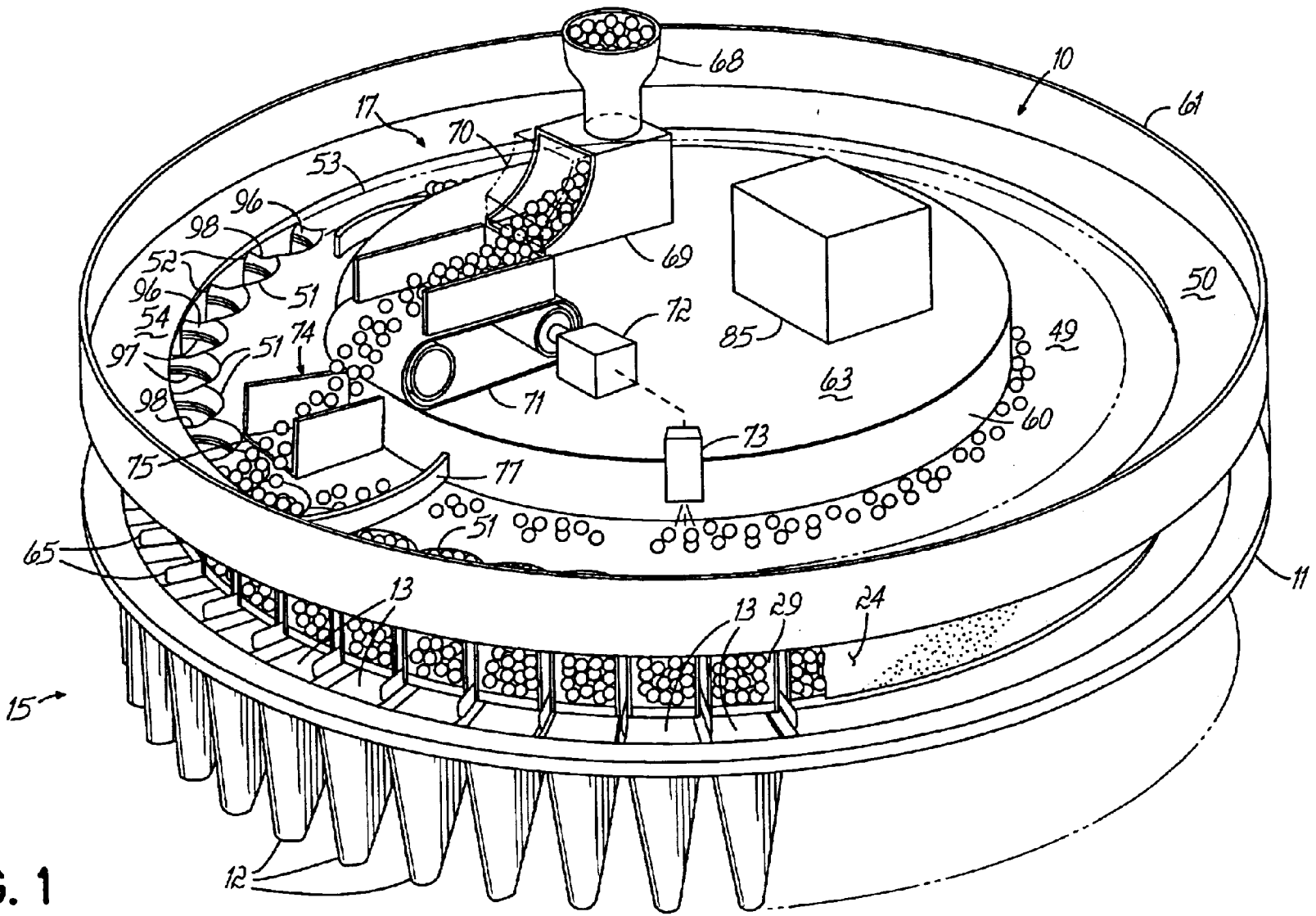
FIG. 1 is a perspective illustration of a volumetric feeder according to the invention, with part of the discharge belt broken away to show individual product charges in their respective chambers.

Turning now to the drawings, there is shown in FIG. 1 a perspective view of an adjustable side discharge feeder 10 according to the invention. Feeder 10 is useful to feed a variety of products for packaging in a plurality of pouches (not shown) for example. In such use, feeder 10 is preferably associated with a spout plate 11 for receiving product from the feeder and delivering fed products through spouts 12 to a plurality of pouches. Such spout plates in association with spout filler wheels are generally well known. See, for example, U.S. Pat. Nos. 3,821,873; 5,320,146; 5,502,951 and 6,1 19,440, all of which are herein incorporated by reference. The pouch handling mechanisms of these form no part of the present invention. Instead, this invention relates to the feeding of the product as shown in the Figs.

In particular, and while useful for feeding a variety of products, feeder 10 is particularly useful for feeding products classified or described in the industry as large particulates. While prior feeders are particularly useful in feeding products in small particulate form, such as powders, such prior devices do not readily lend themselves to handling and feeding products in larger particulate form. Such products include such items as cereals, pet foods, candies, snacks, chips and the like, which are substantially larger than powder class particulates, Accordingly, the feeder 10 comprises an adjustable side discharge volumetric feeder 15. It is served or supplied, preferably, by a means for delivering large particulate product to side discharge feeder 15, such as a rate feeder 17. Any other devices or means for delivering measured product to side feeder 15 could be used, within the scope of the invention. Preferably, the device for feeding product onto side discharge feeder 15 is capable of feeding a measured amount of large particulates in gentle fashion, as will be further described.

Components of an adjustable side discharge feeder 15 according to the invention is best seen in the Figs. in the form of a wheel 20 (FIG. 3) carrying a plurality of open-sided volumetric discharge chambers 22 (FIGS. 4 and 5) through a circular path or arc about the wheel's periphery. The open chamber sides face outwardly from the periphery of the wheel 20 so product therein can be discharged radially outwardly as the wheel 20 turns.

Figure 2:
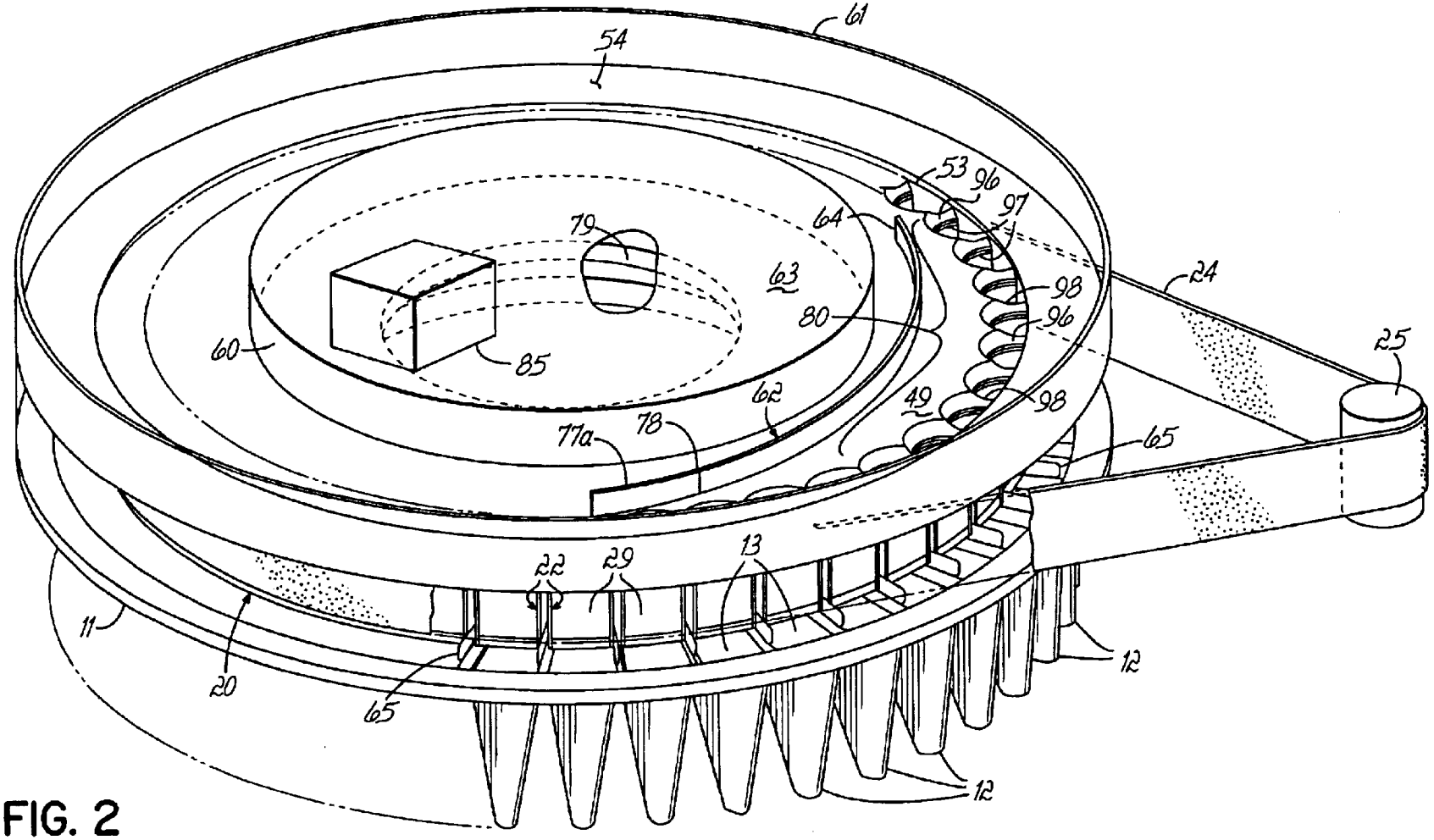
FIG. 2 is another perspective illustration of the invention of FIG. 1 with certain elements removed or added for clarity.

A belt 24 as in FIG. 2 (partially broken away in FIG. 1 to show individual product charges in their respective chambers) is oriented around wheel 20 and closes off the open sides of the chambers 22 through a portion of the arc, including a feed portion where product is delivered to the chambers. Belt 24 is directed away from wheel 20 by a pulley 25, then returns to the wheel as shown in FIG. 2. When the belt is directed away from the wheel, this opens the open sides of chambers 22 for discharge of product therefrom through a discharge portion 80 of the arc in which they travel.

Figure 4:
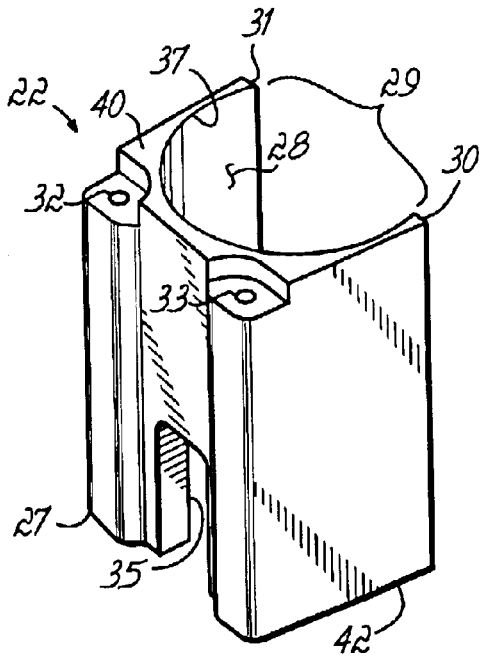
FIG. 4 is a perspective view of an adjustable puck defining a movable bottom of the chamber of FIG. 4.
Figure 5:
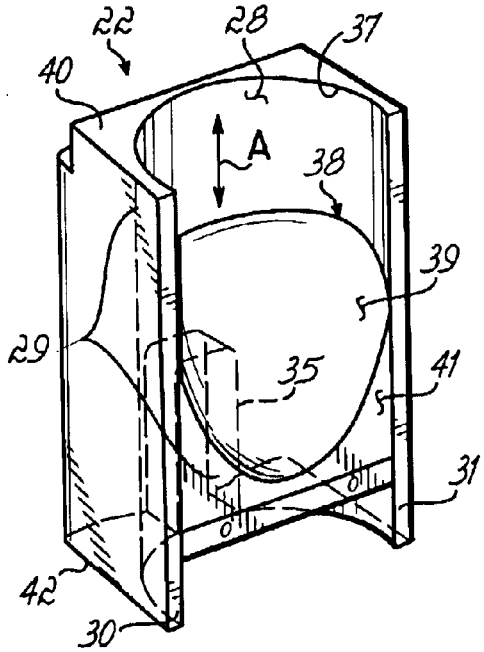
FIG. 5 is a perspective view of the front of the chamber and puck of FIG. 4.
Figure 6:
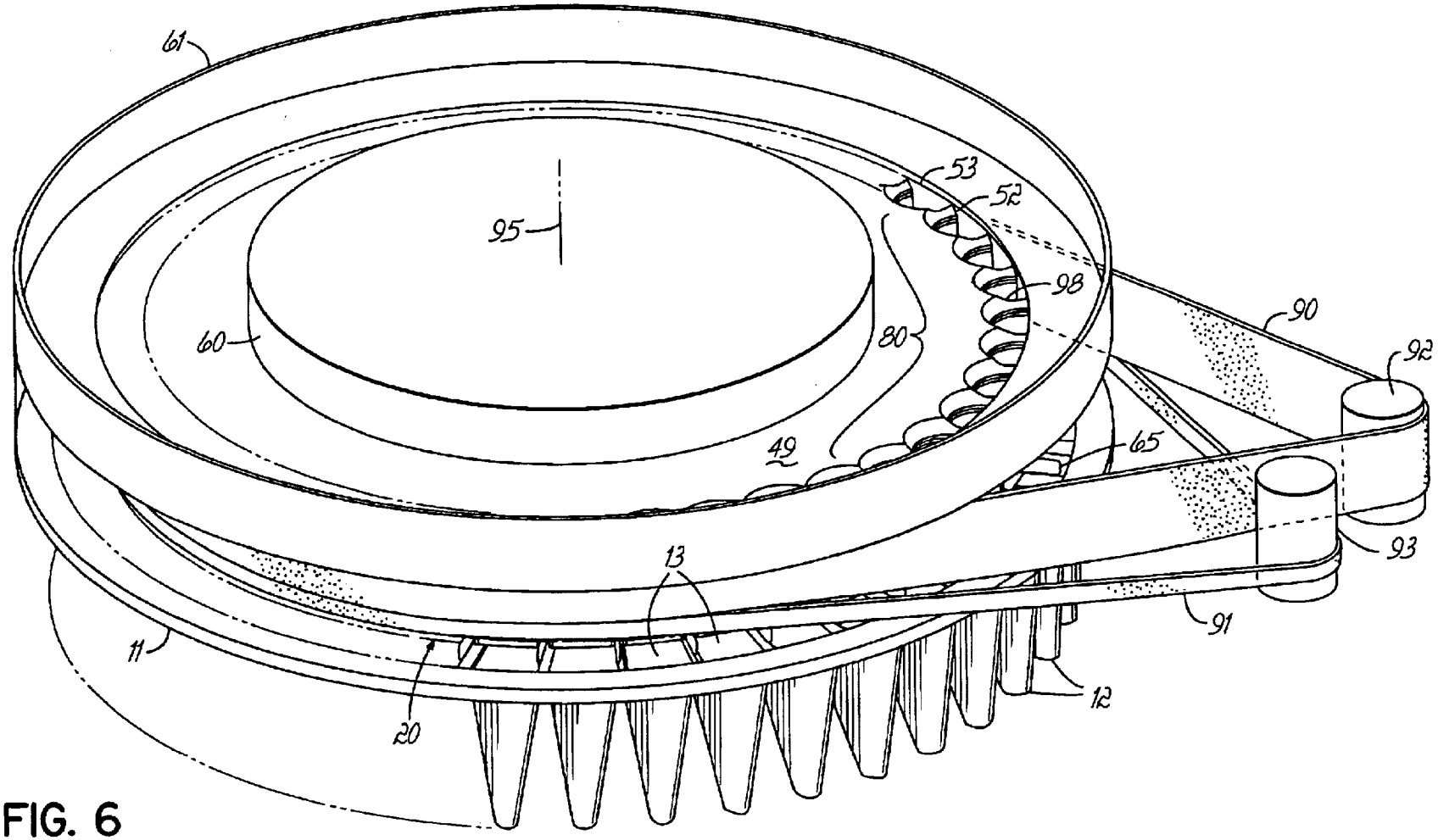
FIG. 6 is a perspective view of an alternate embodiment of the invention.

The chambers 22 preferably comprise integral extrusions 27 of any suitable material such as an extrudable synthetic. As shown in FIGS. 4 and 5, the chambers have a curved interior side wall 28 and an open side 29 defined between edges 30, 31. Through bores 32, 33 for mounting the chambers in wheel 20 are provided in the extrusion as shown. A slot 35 is oriented in a rear wall 36 of the chamber 22 for volumetric adjustment as will be described.

An adjustable puck member 38 is slidably disposed in chamber 22 and is shaped to correspond to curved inner wall 28 with sufficient tolerance to permit sliding of puck 38 in the chamber. Puck 38 defines a chamber bottom surface 39, and has a forward, outwardly facing face surface 41 preferably coplanar with edges 30, 31 of chamber 22.

Puck 38 is selectively moved in the direction of arrow A, FIG. 5, to adjust the volume of the chamber. When puck 38 is raised, as viewed in FIG. 5, chamber volume is diminished. When puck 38 is lowered, chamber volume is increased. An adjustable arm (not shown in FIG. 5) extends through slot 35 to so move the puck 38 as will be described.

It will be appreciated that the upper surface 39 of pucks 38 defining a chamber wall, and here the bottom chamber wall, are tapered downwardly and may be of concave or other complex shapes opening to open side 29 to freely allow filling of large particulates in chambers 22, and free discharge therefrom without constriction and without product bridging. In this way, the product path through the chamber is not constricted or uniform, but is wide but diverging and prevents product bridging while, at the same time, providing for volumetric adjustment.

Figure 3:
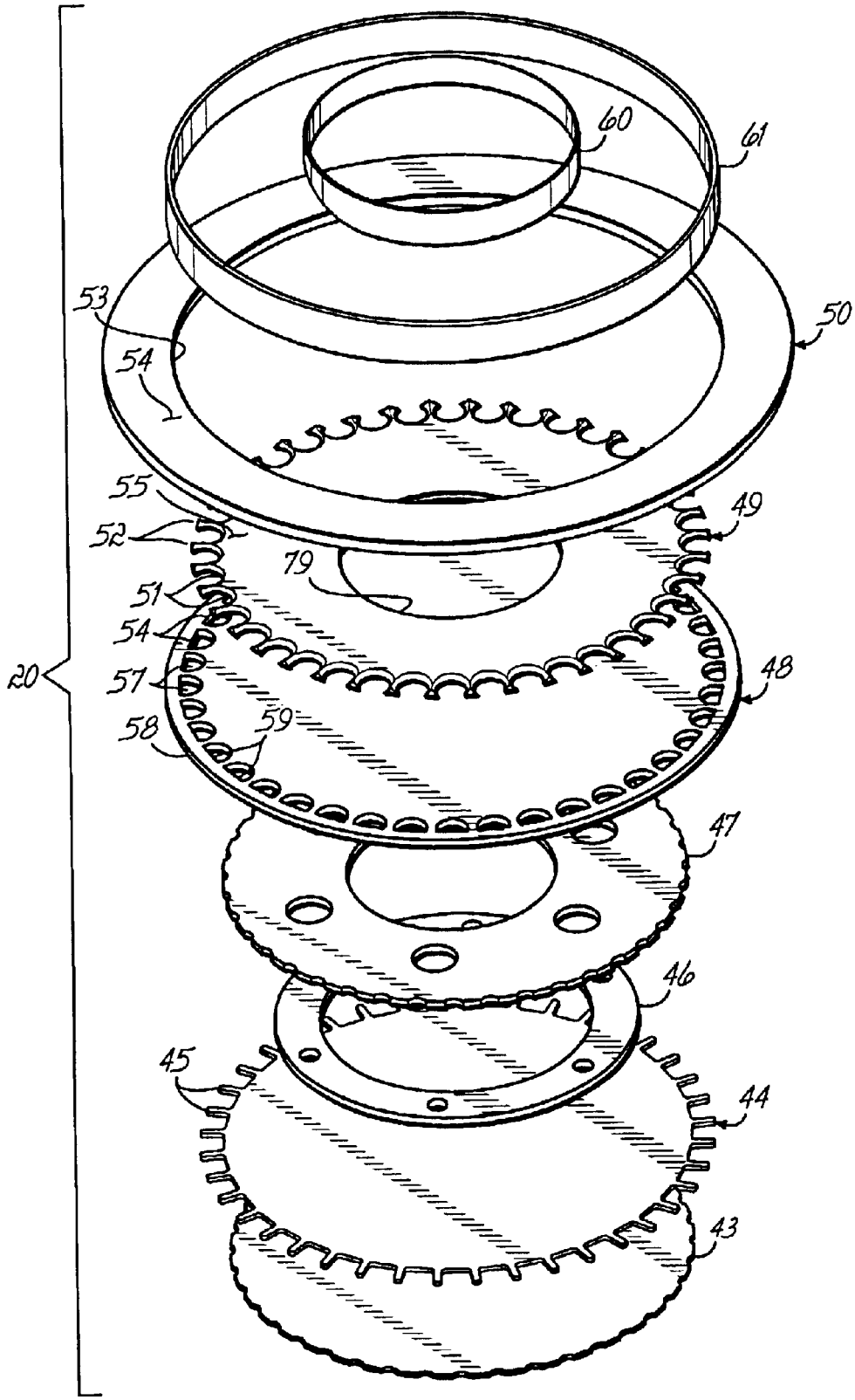
FIG. 3 is a perspective illustration of components of the feeder wheel of the invention in expanded view for descriptive purposes.

Certain components of wheel 20 are perhaps best seen in FIG. 3. A lower chamber support plate 43 is provided to support the lower end 42 (FIGS. 4, 5) of the chambers 22 through holes (not shown) accommodating bolts extending through bores 32, 33 of chamber 22.

An adjustable lift plate 44 is provided with a plurality of radially-extending, puck-adjusting arms 45. These arms are connected to pucks 38, respectively, through slots 35 in chambers 22 for moving the pucks 38 to adjust the volumes of chambers 38 as plate 44 is lifted or lowered. A lifting ring 46 is attached to plate 44 as will further be described.

An upper chamber support plate 47 is mounted in a fixed distance to plate 43 and is adapted to mount and support upper ends of chamber 22 by means of holes (not shown) for receiving bolts (not shown) extending through chamber bores 32, 33 between plates 43, 47.

A support plate 48 is oriented above plate 47 and serves to support both a scalloped top plate 49 and outer ring plate 50. Plate 49 is provided with a scalloped peripheral edge comprising a plurality of open-ended scallops 51 defined by radially extending projections 52 terminating in ends defining the outer edge of plate 49. These edges have an outer diameter which just fits the inner diameter edge 53 of ring plate 50. When assembled, an upper surface 54 of ring plate 50 is preferably co-planar with upper surface 55 of plate 49.

Support plate 48 is provided with a series of openings 57 near its peripheral edge 58. These openings correspond to the scallops 51 in plate 49, and are in register with such scallops 51 as well as with the open tops 37 (FIGS. 4, 5) of chambers 22. Openings 57 in support plate 48 have outer edges 59 which define a circle having the same diameter as the inner diameter of edge 53 of ring plate 50.

It will be appreciated that top surfaces 54 of ring 50 and 55 of top plate 49 define product receiving surfaces for receiving product.

It will be appreciated that scallops 51 in plate 49, and openings 57 in plate 48 are defined by surfaces facilitating free passage of product into chambers 22.

The projections 52, defining the scallops, as well as the circular scalloped surfaces in plate 49, comprise surfaces 96 tapered inwardly through the thickness of plate 49 so the scalloped openings 51 are funnel-like in taper and downwardly toward chambers 22. Openings 57 in plate 48 are likewise tapered downwardly and inwardly with funnel-like surfaces 97. The lower portions of surfaces 97 blend with the open tops 37 of chambers 52, and the lower portions of surfaces 96 blend with upper portions of surfaces 97. The scallops 51 and openings 57 thus provide a funnel-shaped, gentle inward, and preferably steep, taper into chambers 22 for gently handling product flowing therein.

Moreover, the top edges 98 of projections 52 lie in a plane slightly lower than the plane of surfaces 54, 55. The combination of the scallop shaped openings 51 and the relieved top edges 98 of projection 52 serve to facilitate product handling of large particulates without product grinding or degradation as product falls into chambers 22 and as product is swept under wiper 77.

Accordingly, the scallop shape facilitates minimization of product breakage as a top product wiper 77 which ultimately determines allowable volume, approaches (relatively) the edge of the scallops 51. The scalloped shape provides improved particulate nesting and minimizes breakage.

An inner fence 60 is disposed on surface 53 of plate 49 and an outer fence 61 is disposed about the outer edge of ring 50. A circular cover plate (not shown in FIG. 3) is disposed over fence 60 (FIGS. 1 and 2). It will be appreciated that product fence 61 keeps product from falling off wheel 20, while fence 60 keeps product from falling into the open central area defined by circular inner edge 79 of plate 49.

In use, wheel 20 is disposed above a spout plate 11 (FIGS. 1 and 2) so the open sides 29 of chambers 22 are oriented radially inwardly of, and above, open mouths 13 of spouts 12. Product discharging from chambers 22 falls into mouths 13 of spouts 12.

To help direct product discharging from chambers 22 into mouth 13, deflectors 65 (FIG. 2) are disposed between and just above each of the mouths 13. Deflectors 65 are mounted or are connected to lift plate 44 so they are lifted and lowered along with pucks 38 as the chamber volumes are adjusted.

Returning to FIG. 1, the product rate feeder 17 comprises a product hopper 68 which discharges product, such as large particulate product, into lower hopper chamber 69. An adjustable gate 70 is opened to control product flow out of chamber 69 onto metering belt 71. Metering belt 71 is driven by any suitable drive 72, and an associated control of any suitable form receiving signal from product height detecting sensor 73 as will be described, to drive belt 71 and feed an amount of product at a desired rate onto a vibratory tray 74. Product is discharged from the end 75 of tray 74 onto surfaces 54 and 55 of ring plate 50 and scalloped plate 49, and preferably over scallops 51. Product falls both into the open mouths of chambers 22 defined by scallops 51 and openings 57, and onto surfaces 54, 55.

A curved final wiper 77 is disposed a selected distance above surfaces 54, 55 and serves to doctor or wipe product, very gently into chambers 22.

In a preferred embodiment, top product wiper 77 is stationarily oriented above plate 49 and ring 50. The bottom edge of the wiper may be spaced very close to plate 49, ring 50 or slightly spaced therefrom so some product moves thereunder, to the inner upper surfaces of plate 49 as shown in FIG. 1. Where the speed of plate 49 and ring 50 is such that centrifugal force urges product outwardly, where it could fall into chambers 22 which have been uncovered by belt 24 for discharge, or where the product shape allows it to slide or roll outwardly, an alternate guide 77A (FIG. 2) can be used. Guide 77A has an end 78 which is operably associated with a further intermediate fence 62 stationarily mounted over plate 49. Fence 62 retains product inwardly of scallops 51 and chambers 22 as the chambers 22 are uncovered by belt 24 in discharge are 80. Fence 62 can terminate at an end 64 disposed at an angular position so any product flowing past end 64 can move outwardly but beyond where belt 24 recovers and closes open chamber walls 22. Dropping of product into chambers 22 beyond this point is acceptable since the chambers are thus closed and are being moved back for another refill and discharge cycle.

Sensor 73 is disposed downstream of wiper 77 and oriented to detect the height or depth of product remaining on surfaces 54, 55 which did not fall into chambers 22. If the detected height is higher than a selected value, the sensor signal initiates drive control and drive 72 to slow belt 71 to slow the rate of product discharge from belt 71 and tray 74. Similarly, if the detected product level is lower than a selected value, the drive 72, in response, speeds up belt 71 to discharge product at a higher rate. Any suitable form of sensing, belt drive and control can be used as will be clearly appreciated.

Of course, wheel 20 is spinning while product is being discharged. It will be appreciated that product is discharged freely onto and along moving surfaces 54, 55 in a gentle, free flowing manner, and is not captured by any discharge spout or cup causing grinding of product on these surfaces.

As wheel 20 turns, the belt 24 departs the edges 30, 31 of filled chambers 22 as well as outer-facing surface 41 of pucks 38. This occurs progressively and gently, wholly opening the open side 29 of chambers 22 for a gentle product discharge radially from wheel 20. Product falls into mouths 13 of spouts 12 for further packaging, such as in pouches (not shown). The chambers move through a discharge arc 80 (FIG. 2) where they are uncovered by the belts 24 as they are carried in a circular path by wheel 20.

It will also be appreciated that it is desirable to adjust the volume of chambers 22 to change the volumetric quantity of product in the chambers 22 for discharge. This occurs where different products or different volumetric capacities for varied package sizes are desired. It can also occur where it appears that there is a long term trend in one direction or another in the density of product discharged.

Figure 2A:
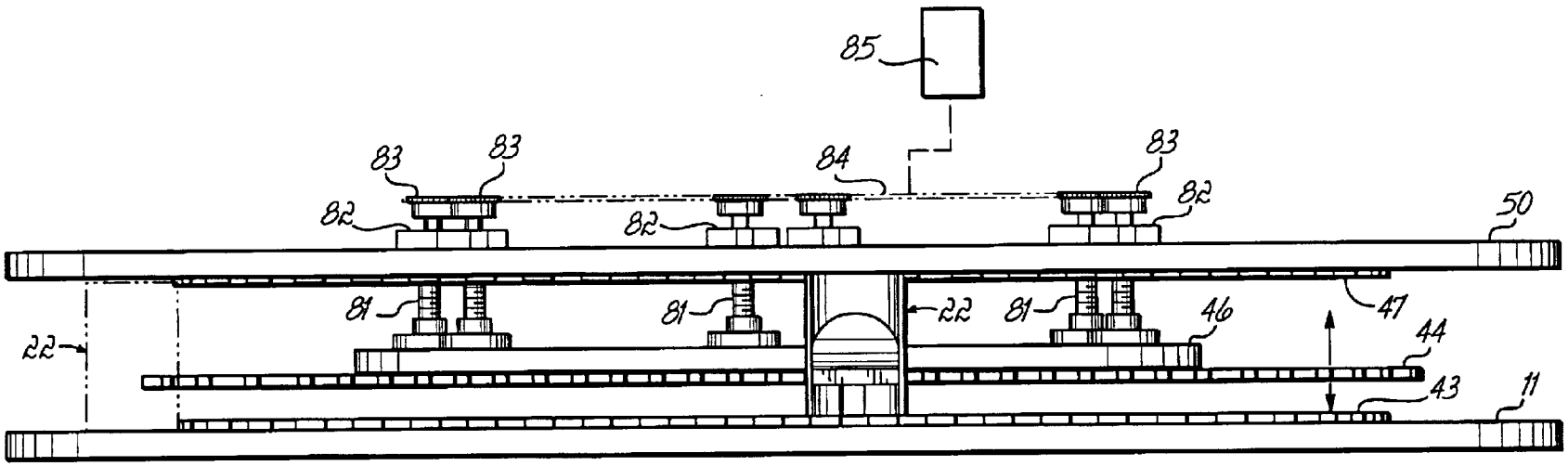
FIG. 2A is a side elevational view of portions of the invention illustrating volume adjustment components of the invention.

To this end, pucks 38 are lifted or lowered to adjust the volume of chambers 22. Reference is made to FIG. 2A. Here, a plurality of driven adjusting screws 81 are attached to lift ring 46 and thus to adjustable lift plate 44. The screws reside in threaded nuts or journals 82 on upper chamber support plate 47 and are provided with sprockets 83 operably connected by a chain 84 to a drive such as a gear motor or servo drive 85.

Motor 85 is activated by any suitable control, not shown, for rotating sprockets and screws 81 to selectively raise or lower plate 44 and thus the pucks 38 (and deflectors 65). As the pucks 38 are raised, volume of chambers 22 is reduced. When the pucks 38 are lowered, the volume of chambers 22 is enlarged. A commutator or other electrical connection is used to power motor 85 as will be appreciated.

It will also be appreciated that the size of volume of chambers 22 can be set or adjusted by manual or automatic control to preselected positions for particular products at package sites, or automatically in response to fill, weigh or other parameters as desired.

In an alternate form of the invention, it will be appreciated that belt 24 could be replaced by two belts 90, 91 (or more), one belt 90 covering the upper open side 29 of chambers 22, and the other belt 91 covering a lower portion of that same side. One belt 90 is drawn off the wheel 20 by a pulley 92 and belt 91 is drawn off by a pulley 93. Pulleys 92, 93 are oriented at different radial angles from an axis of rotation 95 of wheel 20, thus one belt uncovers a portion of open chamber side 29 before the other as wheel 20 spins. In this way, the discharge is staged, and may provide an even gentler handling of product.

It will also be appreciated in a further embodiment, that belts 24, 90 or 91 may be vibrated by any suitable means to enhance chamber filling and discharge.

This feeder is particularly useful in feeder product in large particulate format into pouches, for example, in the system disclosed in U.S. patent application Ser. No. 60/371,484, filed on even date herewith, entitled "STAND-UP POUCH FORMING, FILLING AND SEALING" and naming the following inventors: Frank G. Oliverio; Boris E. Makutonin; David P. Hizer; Lawrence K. Jones and Robert J. Burkhardt. That application is herewith incorporated herein by reference.

Accordingly, large particulate product is volumetrically separated and discharged for packaging at continuous high speed and without bridging or degradation as it flows through the system. The volumetric measure of the product is adjustable to accommodate varied large particulates, or volumetric sizes. Discharge is from the open sides of volumetric chambers 22, and the discharge path through the chambers 22 diverges to prevent product constriction and bridging.

These, and other modifications and alternative embodiments of the invention will be readily apparent from the foregoing to those of ordinary skill in the art and without departing from the scope of the invention and applicants intend to be bound only by the claims appended hereto.

What is claimed is:

1. A volumetric feeder comprising:

a plurality of volumetric chambers mounted for rotation about an axis, a side of said chambers being opened;

a movable puck defining a wall of chambers in said plurality, said puck being movable in a direction parallel to said axis; and a flexible belt defining a wall of said chambers across said open side and throughout a portion of their movement, said belt being movable away from said chambers for discharge of product therefrom.

2. A feeder as in claim 1 wherein said chambers are mounted on a wheel and define an outer periphery of said wheel, said belt engaging and closing said chambers about a portion of said periphery, said belt directed away from said chamber in a discharge area of said periphery.

3. A feeder as in claim 1 wherein said pucks are movable to adjust the volume of said chamber, and including puck adjusters movable to simultaneously adjust all of said pucks.

4. A feeder as in claim 3 including an adjuster drive moving said puck adjusters in response to changes in the volume of product discharged from said chambers.

5. A feeder as in claim 1 including a product rate feeder for feeding product to said chambers at a predetermined rate.

6. A volumetric feeder comprising:

a plurality of volumetric chambers mounted on a wheel rotatable about an axis, a side of said chamber being opened;

a movable puck defining a wall of each chamber in said plurality, said puck being movable in a direction parallel to said axis; and a flexible belt defining a wall of said chamber across said open side, said belt being movable away from said chamber for discharge of product therefrom, wherein said rate feeder includes a conveyor belt and a downstream vibratory tray, said tray conveying product discharged from said belt to said chambers.

7. A feeder as in claim 6 including a sensor for detecting changes in the height of product dispensed over said chambers and adjusting the rate of product feed over said chambers in response to said detecting.

8. A feeder as in claim 1 including a top plate, said chambers being disposed proximate an edge of said plate about a periphery thereof, and having chamber mouths defined in said plate;

apparatus feeding product on said top plate; and a wiper disposed above and across a portion of said top plate for doctoring the height of product fed onto said top plate and above said chambers.

9. A volumetric feeder comprising:

a plurality of volumetric chambers mounted on a wheel rotatable about an axis, a side of said chamber being opened;

a movable, puck defining a wall of each chamber in said plurality, said puck being movable in a direction parallel to said axis; and a flexible belt defining a wall of said chamber across said open side, said belt being movable away from said chamber for discharge of product therefrom, and further including a top plate defining chamber mouths proximate a periphery of said plate, a lower plate supporting a lower end of said chambers; and an adjustable lift plate operably attached to said pucks and being selectively movable toward and away from said top plate to respectively reduce and enlarge the volume of said chambers.

10. A feeder as in claim 9 further including:

a lower chamber support plate;

an upper chamber support plate;

said upper and lower chamber support plates supporting said plurality of chambers;

said lifting plate operably disposed between said upper and lower chamber support plates.

11. A feeder as in claim 10 wherein said upper and lower chamber support plates are secured together a fixed distance, one from the other.

12. A feeder as in claim 9 including an outer ring surrounding said top plate and defining said chamber mouths with said top plate.

13. A feeder as in claim 12 including a top support plate disposed beneath said top plate and said outer ring, said top support plate including a plurality of openings operably registered with said chamber mouths.

14. A feeder as in claim 9 further including a lifting ring operably attached to said adjustable lift plate.

15. A feeder as in claim 10 further including a lifting ring operably attached to said adjustable lifting plate and a plurality of adjusting screws operably attached between said lifting ring and said upper chamber support plate for selectively raising and lowering said adjustable lifting plate and said pucks to vary the size of said volumetric chambers.

16. A feeder as in claim 15 further including means for rotating said adjusting screws to adjust the volume of said chambers.

17. A volumetric feeder comprising:

a plurality of volumetric chambers mounted on a wheel rotatable about an axis, a side of said chamber being opened;

a movable puck defining a wall of each chamber in said plurality, said puck being movable in a direction parallel to said axis; and a flexible belt defining a wall of said chamber across said open side, said belt being movable away from said chamber for discharge of product therefrom, and wherein said chambers are defined by a plurality of chamber extrusions, a puck in each chamber defining a wall thereof, and a slot in said extrusion for accommodating an adjuster to move said puck in said chamber.

18. A feeder as in claim 1 wherein said chambers are disposed for movement in a path about the periphery of a wheel rotable about said axis, with an open side of said chambers facing radially outward of said wheel, said belt covering the open sides of a plurality of said chambers and being spaced away from open sides of said chambers in a discharge arc portion of said path.

19. A feeder as in claim 18 further including a plurality of product spouts having respective open mouths for receiving products discharged from open sides of said chambers said open spout mouths being disposed in a circular orientation radially outwardly from and beneath said open sides of said chambers.

20. A volumetric feeder comprising:

a plurality of volumetric chambers mounted on a wheel rotatable about an axis, a side of said chamber being opened;

a movable puck defining a wall of each chamber in said plurality, said puck being movable in a direction parallel to said axis; and a flexable belt defining a wall of said chamber across said open side, said belt being movable away from said chamber for discharge of product therefrom, and wherein said chambers are disposed for movement in a path about the periphery of a wheel rotatable a said axis, with an open side of said chambers facing radially outward of said wheel, said belt covering the open sides of a plurality of said chambers and being spaced away from open sides of said chambers in a discharge arc portion of said path, further including a plurality of product spouts having respective open mouths for receiving products discarded from open sides of said chambers, said open spout mouths being disposed in a circular orientation radially outwardly from and beneath said open sides of said chambers, and further including a deflector at edges of each spout mouth, extending upwardly therefrom for deflecting product discharging from said chambers into respective spout mouths therebetween.

21. A feeder as in claim 20 wherein said deflectors are movable with said pucks.

22. A feeder as in claim 1 wherein said chambers extend downwardly from a top plate defining mouths of said chambers, said mouths in said top plate being tapered inwardly in the thickness of said top plate and being of curvilinear planar opening in said plate.

23. A volumetric feeder comprising:

a plurality of volumetric chambers mounted on a wheel rotatable about an axis, a side of said chamber being opened;

a movable puck defining a wall of each chamber in said plurality, said puck being movable in a direction parallel to said axis; and a flexible belt defining a wall of said chamber across said open side, said belt being movable away from said chamber for discharge of product therefrom, wherein said chambers extend downwardly from a top plate defining mouths of said chambers, said mouths in said top plate being tapered inwardly in the thickness of said top plate and being of curvilinear planar opening in said plate, and wherein said top plate comprises an inner plate having a plurality of scallops forming said mouths and an outer ring defining an outer periphery of said mouths.

24. A feeder as in claim 23 wherein said scalloped mouths include radially extending edges disposed in a plane beneath the plane of said top plate at radially inward portions of said mouths defined therein.

25. A volumetric feeder comprising:

a product receiving plate defining in part a plurality of volumetric chamber mouths and rotable about an axis;

a plurality of volumetric chambers depending downwardly from said mouths and having open sides and volume adjusting bottom pucks movable in a direction parallel to said axis;

a flexible belt covering said open chamber sides and forming a chamber wall of selected chambers, and said belt being movable away from said chambers as said chambers move in a path to uncover said open chamber sides in a product discharge portion of said path.

26. A feeder as in claim 25 further including a product wiper for wiping product into said chambers, and an interior fence extending downstream of said wiper for retaining product on said plate away from any chambers at a time when said belt is moved away from said open chamber sides.

27. A feeder as in claim 25 wherein portions of said mouths in said plates are curvilinear.

28. A feeder as in claim 25 wherein portions of said mouths in said plate are disposed in a lower plane than more inward portions of said mouths.

29. In a method of feeding variable volumetric changes of product, the steps comprising:

delivering product to a plurality of volumetric chambers rotatable about an axis, said chambers having movable surfaces respectively defining a wall of said chambers and said chambers having open side walls;

moving said surfaces into a direction parallel to said axis to adjust volume of said chamber;

covering said side walls with a belt defining a movable chamber side wall;

moving said belt away from said chambers to open said chambers; and discharging product from said chambers when said belt is moved away from said chambers.

30. A method as in claim 29 comprising the further step of adjusting the position of said movable surfaces in said chambers and thereby adjusting the volumetric space within said chambers.

31. A method as in claim 29 wherein the delivery step includes delivering product of large particulate configuration.

32. A method as in claim 29 comprising the further step of feeding product to said volumetric chambers at a selected product feed rate and thereafter discharging product from said volumetric chambers.

33. A method as in claim 32 wherein said volumetric chambers have respective open mouths defined in a plate and including the further step of delivering product at a selected feed rate onto said plate and into the open mouths of said chamber.

34. A method as in claim 33 including the step of adjusting said feed rate in response to changes in the depth of product delivered to said plate.

35. A method as in claim 29 wherein the step of covering said sidewalls includes covering said side walls with two belts, each defining a portion of a movable chamber side wall.

36. A method as in claim 35 including the step of moving said belts away from said chambers at different locations and staging the discharge of product therefrom.

37. A volumetric feeder comprising:

a plurality of volumetric chambers mounted for rotation about a vertical axis, a side of said chamber being opened;

a movable puck defining a wall of each chamber in said plurality, said puck being movable in a direction parallel to said axis; and a flexible belt defining a wall of said chamber across said open side, said belt being movable away from said chamber for discharge of product therefrom.

* * * * *